US007023303B1

(12) United States Patent
Bogdon et al.

(10) Patent No.: US 7,023,303 B1
(45) Date of Patent: Apr. 4, 2006

(54) ACTUATOR FOR AUXILIARY SWITCH AND CIRCUIT BREAKER INCORPORATING THE SAME

(75) Inventors: Erik R. Bogdon, Carnegie, PA (US); Dave E. Little, Midland, PA (US); Dave A. Parks, Baden, PA (US); Dave C. Turner, Imperial, PA (US); James A. Trax, Oakdale, PA (US); Dominic P. Martelli, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/218,898

(22) Filed: Sep. 2, 2005

Related U.S. Application Data

(60) Provisional application No. 60/615,446, filed on Oct. 1, 2004.

(51) Int. Cl.
*H01H 9/00* (2006.01)

(52) U.S. Cl. ..... 335/6; 335/10; 335/13; 335/17

(58) Field of Classification Search ..... 200/330–332.2, 200/339, 553; 335/6–17, 172
See application file for complete search history.

(56) References Cited

U.S. PATENT DOCUMENTS

| | | | | |
|---|---|---|---|---|
| 4,209,761 | A | 6/1980 | Klein et al. | |
| 4,211,989 | A | 7/1980 | Acampora | |
| 4,314,121 | A | 2/1982 | Gaber | |
| 4,418,254 | A | 11/1983 | Busby et al. | |
| 4,831,221 | A | 5/1989 | Yu et al. | |
| 5,172,088 | A | 12/1992 | Morgan | |
| 5,880,419 | A | 3/1999 | Chou | |
| 5,907,461 | A | 5/1999 | Hartzel et al. | |
| 6,166,616 | A * | 12/2000 | Fischer et al. | 335/172 |
| 6,232,855 | B1 | 5/2001 | Malingowski et al. | |
| 6,903,636 | B1 | 6/2005 | Fischer | |

* cited by examiner

*Primary Examiner*—Ramon M. Barrera
(74) *Attorney, Agent, or Firm*—Martin J. Moran

(57) ABSTRACT

A U-shaped accessory actuator clip that snaps onto the crossbar of a multipole circuit breaker is integrally molded of a compliant material with a flexible finger that actuates/deactuates an accessory, such as an auxiliary switch, as the contacts of the breaker close and open.

20 Claims, 4 Drawing Sheets

ACTUATOR FOR AUXILIARY SWITCH AND CIRCUIT BREAKER INCORPORATING THE SAME

CROSS REFERENCE TO RELATED APPLICATION

This application claims the benefit of U.S. Provisional Patent Application Ser. No. 60/615,446, filed Oct. 1, 2004.

BACKGROUND OF THE INVENTION

1. Field of the Invention

This invention relates to circuit breakers with auxiliary switches that signal the state of the breaker contacts and, more particularly, to arrangements for actuating the auxiliary switch.

2. Background Information

It is common for many circuit breakers to be provided with an auxiliary switch that signals the open or closed state of the circuit breaker contacts. Often, the auxiliary switch is offered as an option. For instance, the auxiliary switch can be added, if requested, by insertion in a compartment in a primary cover of the circuit breaker that is enclosed by a secondary cover. The plunger of the auxiliary switch extends through an opening in the primary cover where it is actuated by a projection molded on the crossbar that ties the moving contact arms of the multipole circuit breaker together. The crossbar necessarily must be stiff to assure coordinated movement of the contact arms of all of the poles. Thus, the projection on the crossbar which is molded of the same material is stiff and non-compliant.

With this arrangement, there exists the potential for an accumulation of tolerance stack up within the circuit breaker operating mechanism to provide too much or too little travel. This travel may not be sufficient enough to actuate the auxiliary switch, or, excessive travel may damage the auxiliary switch. In previous instances, customizing/modifying plunger lengths was necessary to accommodate this tolerance stack up.

There is, therefore, room for improvement in arrangements for actuating the auxiliary switches in circuit breakers.

SUMMARY OF THE INVENTION

Aspects of the invention are directed to a multipole circuit breaker in which an accessory is actuated by an actuator secured to the crossbar and having a compliant finger that actuates and deactuates a plunger of the accessory while accommodating for variations in travel of the crossbar such as those resulting from tolerances and overtravel.

As one aspect of the invention, a circuit breaker comprises: a housing; a plurality of poles each comprising: separable contacts each comprising a fixed contact and a movable contact, and a contact arm assembly comprising a contact arm having the movable contact affixed to a distal end and a carrier pivotally mounting the contact arm for rotation between a closed position in which the movable contact engages the fixed contact and an open position in which the movable contact is separated from the fixed contact; a crossbar connecting the contact arm assemblies of the poles together as a moving assembly; an operating mechanism coupled to the moving assembly to simultaneously move the contact arms of the poles between the open and closed positions; an accessory having a plunger mounted in the housing adjacent to the crossbar; and an accessory actuator clip secured to and movable with the crossbar and having a finger that engages the plunger to actuate the accessory with the contact arms in one of the open and closed positions and that releases the plunger to deactuate the accessory in the other of the open and closed positions, the finger being complaint to accommodate for variations in travel of the crossbar.

The accessory actuator clip may be molded as a unitary piece from a compliant material.

The accessory actuator clip may comprise a plurality of hooks that secure the accessory actuator clip to the crossbar.

The crossbar may be secured to the carrier of the contact arm assembly of one of the poles with a staple. The staple may include a pair of legs. The accessory actuator clip may be a molded clip that seats over the staple with a pair of hooks engaging the pair of legs of the staple.

The accessory actuator clip may include a pair of legs having distal ends. The staple may include a pair of legs having distal ends. A pair of cleats may project inwardly from the distal ends of the legs of the accessory actuator clip. The legs of the accessory actuator clip may straddle the legs of the staple. The cleats may snap under the distal ends of the legs of the staple to secure the accessory actuator clip to the moving assembly.

The accessory actuator clip may include a U-shape having a base and a pair of parallel legs. The finger may extend at an angle from the outer surface of one of the legs.

As another aspect of the invention, an accessory actuator clip is for a circuit breaker including a housing, a plurality of poles each comprising: separable contacts each comprising a fixed contact and a movable contact, and a contact arm assembly comprising a contact arm having a movable contact affixed to a distal end and a carrier pivotally mounting the contact arm for rotation between a closed position in which the movable contact engages the fixed contact and an open position in which the movable contact is separated from the fixed contact, a crossbar connecting the contact arm assemblies of the poles together as a moving assembly, an operating mechanism coupled to the moving assembly to simultaneously move the contact arms of the poles between the open and closed positions, and an accessory having a plunger mounted in the housing adjacent to the crossbar. The accessory actuator clip comprises: a base; a pair of legs; and a finger extending at an angle from the outer surface of one of the legs, wherein the accessory actuator clip is structured to secure to and be movable with the crossbar, wherein the finger is structured to engage the plunger to actuate the accessory with the contact arms in one of the open and closed positions and to release the plunger to deactuate the accessory in the other of the open and closed positions, and wherein the finger is complaint to accommodate for variations in travel of the crossbar.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
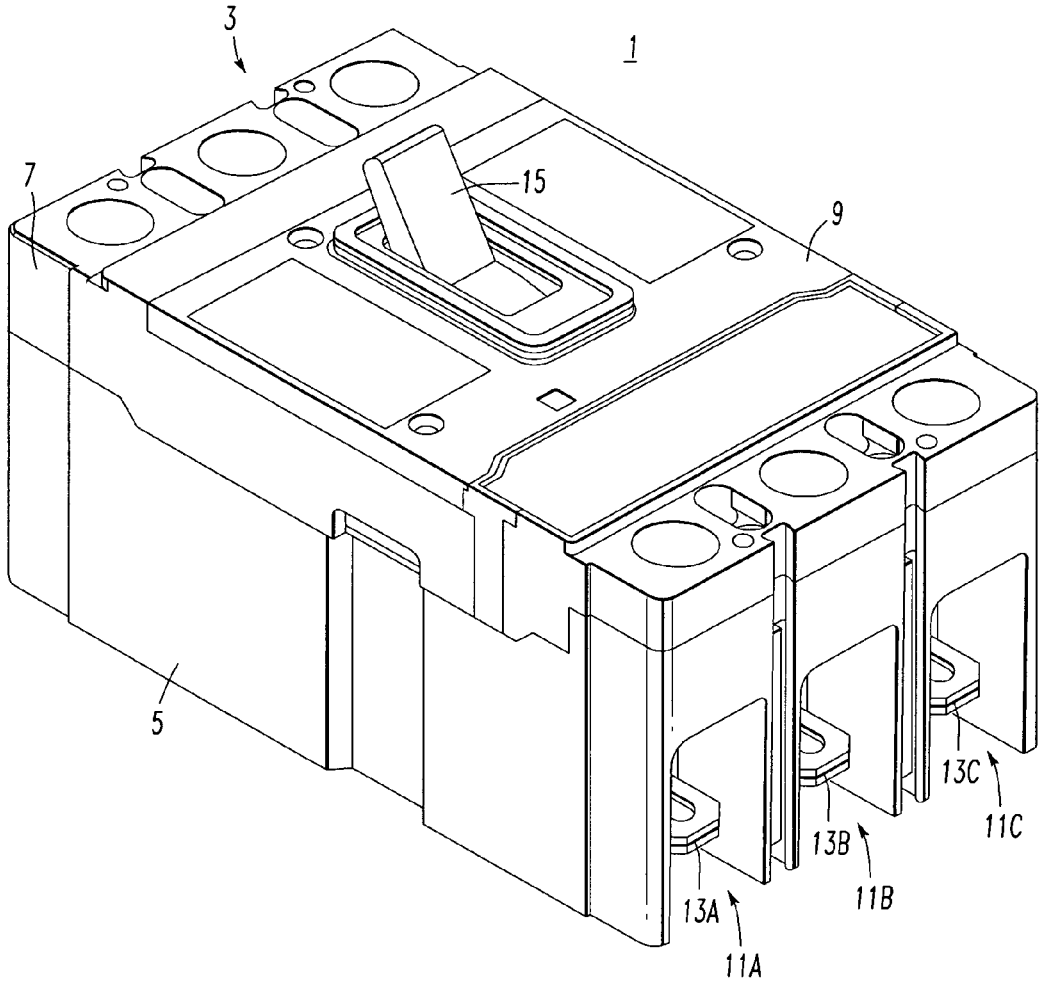
FIG. 1 is an isometric view of a circuit breaker incorporating aspects of the invention.

FIG. 1 illustrates a circuit breaker 1 incorporating aspects of the invention. The circuit breaker 1 has a housing 3 formed by a base 5, a primary cover 7 that mates with the base 5, and a secondary cover 9 seated on the primary cover. The example circuit breaker 1 has three poles 11A, 11B and 11C, although the invention is applicable to circuit breakers having two or more poles. The load conductors 13A, 13B and 13C for these poles are visible in FIG. 1. A handle 15 is used to manually turn the circuit breaker 1 off and on.

Figure 2:
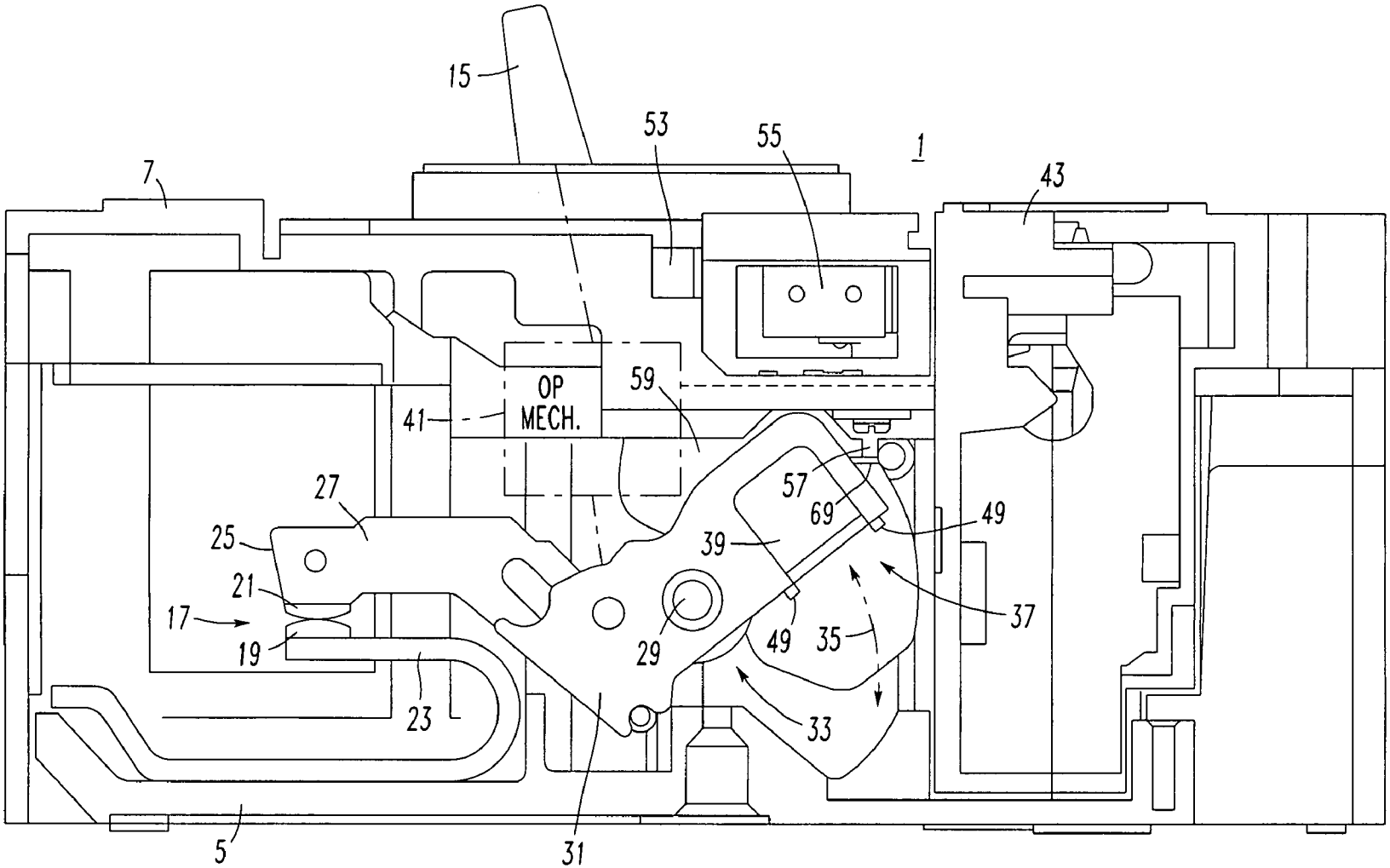
FIG. 2 is a longitudinal sectional view through the circuit breaker of FIG. 1 showing pertinent parts.
Figure 3:
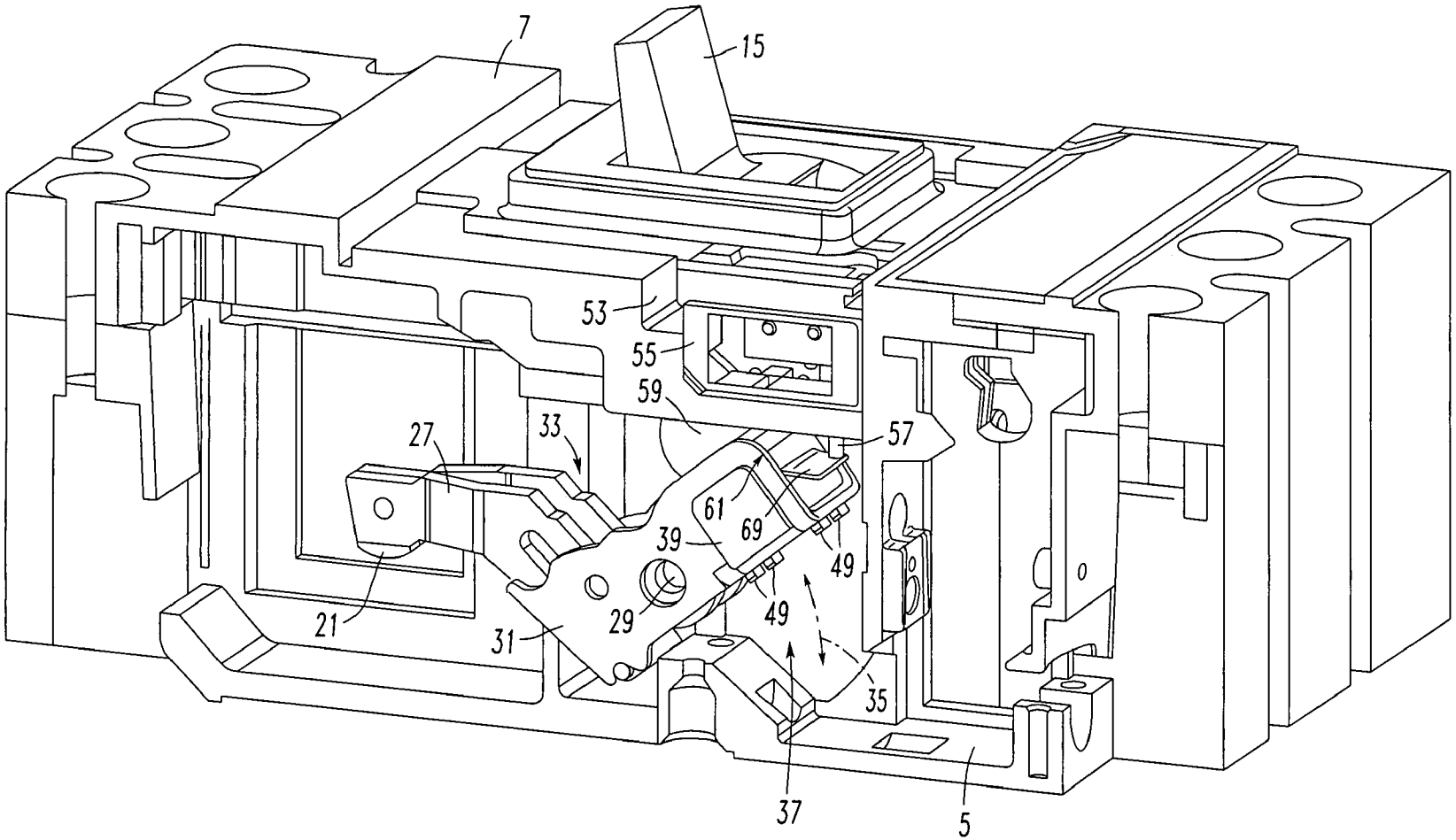
FIG. 3 is an isometric sectional view showing pertinent parts of the circuit breaker of FIG. 1.

FIGS. 2 and 3 illustrate only pertinent internal parts of the circuit breaker 1. Each of the poles of the circuit breaker 1, such as the pole 11A, has separable contacts 17 in the form of a fixed contact 19 and a movable contact 21. The fixed contact 19 is mounted on a line conductor 23, while the movable contact 21 is affixed to the distal end 25 of a contact arm 27. The contact arm 27 is supported for pivotal movement at about an axis 29 by a carrier 31 to form a contact arm assembly 33. As illustrated by the arrows 35, the contact arm assembly 33 is rotatable between a closed position, as shown in FIG. 2, in which the movable contact 21 engages the fixed contact 19 and an open position (not shown) in which the separable contacts 17 are separated.

The contact arm assemblies 33 of the three poles 11A–11C are joined together to form a moving contact assembly 37 by a crossbar 39. As is well known, an operating mechanism 41, typically coupled to the center pole 11B, operates the moving assembly 37 to simultaneously open and close the separable contacts 17 of each of the poles 11A–11C. The operating mechanism 41 can be actuated manually by the handle 15 or automatically in response to specified current/time characteristics of load current by a trip mechanism 43, again as is well known.

Figure 5:
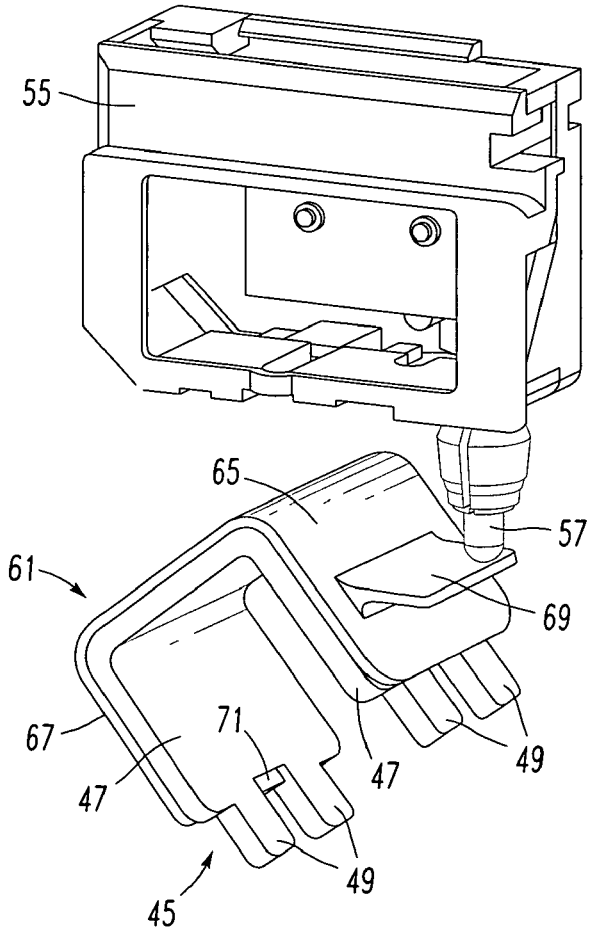
FIG. 5 is an isometric view illustrating the relationship of the accessory actuator clip of FIG. 4 to an auxiliary switch and to its support.

The crossbar 39 is tied to the carrier 31 of each pole 11 by a staple 45. As shown in FIG. 5, the staple 45 has a pair of legs 47 each of which terminates in a pair of stakes 49 that extend through holes in the carrier 31 as can be seen in FIG. 3. The ends of the stakes 49 are spun to secure the staple 45, and therefore, the crossbar 39 to the contact arm assembly 33.

Figure 4:
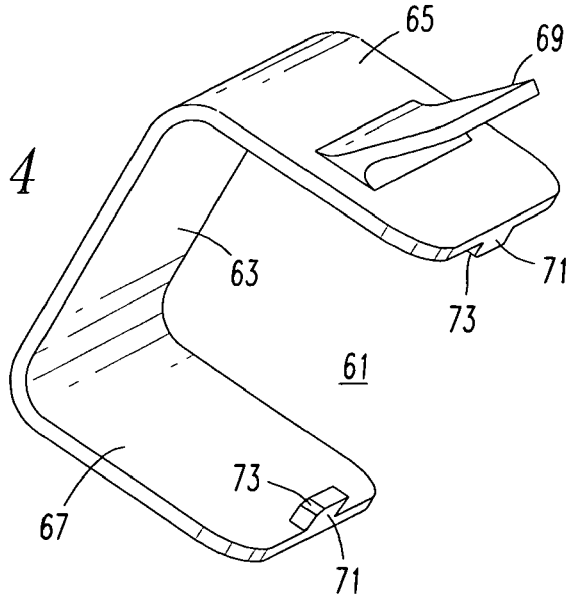
FIG. 4 is an isometric view of an accessory actuator clip in accordance with aspects of the invention.

As shown in FIG. 2, the primary cover 7 of the circuit breaker 1 has a compartment 53 in which is received an accessory such as the auxiliary switch 55. The auxiliary switch 55 is secured in the compartment 55 by the secondary cover 9 (FIG. 1). The auxiliary switch 55 has a plunger 57 that extends downward into the cavity 59 where is it actuated by an accessory actuator clip 61 (FIG. 3). As best seen in FIG. 4, the accessory actuator clip 61 is U-shaped having a base part 63 and a pair of legs 65 and 67 extending in generally parallel planes from the ends of the base part 63. An actuating finger 69 extends at an angle from the outer surface of the leg 65. A pair of hooks, such as cleats 71, chamfered at the lateral edges 73 project inwardly from the distal ends of the legs 65 and 67.

The accessory actuator clip 61 is preferably molded as an integral piece from a compliant material such as, for example, a polyester resin. It is secured on the crossbar 39 by spreading the legs 65 and 67 to straddle the legs 47 of the staple 45 (FIG. 5). When fully seated on the staple 45, the cleats 71 snap under the distal ends of the legs 47 of the staple 45 between the stakes 49 to firmly secure the accessory actuator clip 61 to the moving assembly 37 (FIG. 3). As can be seen from FIGS. 2, 3 and 5, when the contact arm assembly 33 of the pole 11A is in the closed position, the actuating finger 69 of the actuator accessory clip 61 (FIG. 4) engages and actuates the plunger 57 of the auxiliary switch 55. The actuating finger 69 is stiff enough that it overcomes the spring bias on the plunger 57 to actuate the plunger, yet is flexible enough that when the plunger seats, the actuating finger 69 can flex to accommodate for overtravel. This overtravel can result from a stackup of tolerances in the moving assembly 37 which can result in different angular positions of the crossbar 39 when the separable contacts 17 are closed. Additional variations in the final position of the crossbar 39 with the separable contacts 17 closed can be attributed to wear of the fixed and movable contacts 19 and 21. The flexing of the actuating finger 69 due to the compliant material from which it is made easily accommodates for these variations without generating undue stresses.

As mentioned, the accessory in the exemplary embodiment of the invention is the auxiliary switch 55. Such auxiliary switches are commonly used to signal the open/closed state of the separable contacts 17, such as for remote monitoring or operation.

As another example of an accessory, a similar microswitch is typically incorporated into a shunt trip mechanism (not shown), which allows the coil of the shunt trip mechanism to be energized only when the separable contacts 17 are closed. Such a shunt trip mechanism is variously used for remote tripping of the breaker and for electronic tripping, which can include tripping for ground faults and/or arc faults.

Although example accessories are disclosed, a wide range of circuit breaker accessories may be employed with the example accessory actuator clip 61.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a housing;

a plurality of poles each comprising:

separable contacts each comprising a fixed contact and a movable contact, and a contact arm assembly comprising a contact arm having the movable contact affixed to a distal end and a carrier pivotally mounting the contact arm for rotation between a closed position in which the movable contact engages the fixed contact and an open position in which the movable contact is separated from the fixed contact;

a crossbar connecting the contact arm assemblies of the poles together as a moving assembly;

an operating mechanism coupled to the moving assembly to simultaneously move the contact arms of said poles between the open and closed positions;

an accessory having a plunger mounted in the housing adjacent to the crossbar; and an accessory actuator clip secured to and movable with the crossbar and having a finger that engages the plunger to actuate said accessory with the contact arms in one of the open and closed positions and that releases the plunger to deactuate said accessory in the other of the open and closed positions, the finger being complaint to accommodate for variations in travel of the crossbar.

2. The circuit breaker of claim 1 wherein said accessory actuator clip is molded as a unitary piece from a compliant material.

3. The circuit breaker of claim 1 wherein said accessory actuator clip comprises a plurality of hooks that secure said accessory actuator clip to said crossbar.

4. The circuit breaker of claim 1 wherein said crossbar is secured to the carrier of said contact arm assembly of one of said poles with a staple.

5. The circuit breaker of claim 4 wherein said staple includes a pair of legs; and wherein said accessory actuator clip is a molded clip that seats over the staple with a pair of hooks engaging the pair of legs of said staple.

6. The circuit breaker of claim 4 wherein said accessory actuator clip includes a pair of legs having distal ends; wherein said staple includes a pair of legs having distal ends; wherein a pair of cleats project inwardly from the distal ends of said legs of said accessory actuator clip; wherein the legs of said accessory actuator clip straddle the legs of said staple; and wherein said cleats snap under the distal ends of the legs of said staple to secure said accessory actuator clip to said moving assembly.

7. The circuit breaker of claim 1 wherein said accessory is an auxiliary switch.

8. The circuit breaker of claim 1 wherein said housing includes a cavity; and wherein the plunger of said accessory extends into the cavity of said housing where is it actuated by the finger of said accessory actuator clip.

9. The circuit breaker of claim 1 wherein said accessory actuator clip includes a U-shape having a base and a pair of parallel legs; and wherein said finger extends at an angle from the outer surface of one of said legs.

10. The circuit breaker of claim 1 wherein a count of said poles is three.

11. An accessory actuator clip for a circuit breaker including a housing, a plurality of poles each comprising: separable contacts each comprising a fixed contact and a movable contact, and a contact arm assembly comprising a contact arm having the movable contact affixed to a distal end and a carrier pivotally mounting the contact arm for rotation between a closed position in which the movable contact engages the fixed contact and an open position in which the movable contact is separated from the fixed contact, a crossbar connecting the contact arm assemblies of the poles together as a moving assembly, an operating mechanism coupled to the moving assembly to simultaneously move the contact arms of said poles between the open and closed positions, and an accessory having a plunger mounted in the housing adjacent to the crossbar, said accessory actuator clip comprising:

a base;

a pair of legs; and a finger extending at an angle from the outer surface of one of said legs, wherein said accessory actuator clip is structured to secure to and be movable with the crossbar, wherein said finger is structured to engage the plunger to actuate said accessory with the contact arms in one of the open and closed positions and to release the plunger to deactuate said accessory in the other of the open and closed positions, and wherein said finger is complaint to accommodate for variations in travel of the crossbar.

12. The accessory actuator clip of claim 11 wherein said accessory actuator clip is molded as a unitary piece from a compliant material.

13. The accessory actuator clip of claim 11 wherein said legs include a plurality of hooks structured to secure said accessory actuator clip to said crossbar.

14. The accessory actuator clip of claim 11 wherein said crossbar is secured to the carrier of said contact arm assembly of one of said poles with a staple.

15. The accessory actuator clip of claim 14 wherein said staple includes a pair of legs; and wherein said accessory actuator clip is a molded clip that is structured to seat over the staple with a pair of hooks engaging the pair of legs of said staple.

16. The accessory actuator clip of claim 14 wherein the legs of said accessory actuator clip have distal ends; wherein said staple includes a pair of legs having distal ends; wherein a pair of cleats project inwardly from the distal ends of said legs of said accessory actuator clip; wherein the legs of said accessory actuator clip are structured to straddle the legs of said staple; and wherein said cleats are structured to snap under the distal ends of the legs of said staple to secure said accessory actuator clip to said moving assembly.

17. The accessory actuator clip of claim 11 wherein said accessory is an auxiliary switch.

18. The accessory actuator clip of claim 11 wherein said housing includes a cavity; wherein the plunger of said accessory extends into the cavity of said housing; and wherein the finger of said accessory actuator clip is structured to actuate said plunger in said cavity.

19. The accessory actuator clip of claim 11 wherein said accessory actuator clip includes a U-shape formed by said base and said legs.

20. The accessory actuator clip of claim 19 wherein said legs are parallel to each other.

* * * * *